US005701979A

United States Patent [19]

Voich

[11] Patent Number: 5,701,979

[45] Date of Patent: Dec. 30, 1997

[54] BAG THAT MAY BE CONVERTED INTO A FOLDING BACK REST FOR THE BEACH OR PARK

[76] Inventor: Jan Harriet Voich, Paseo de la Habana, 14, 28036 Madrid, Spain

[21] Appl. No.: 677,898

[22] Filed: Jul. 10, 1996

[30] Foreign Application Priority Data

Jul. 13, 1995 [ES] Spain ..... 9501931

[51] Int. Cl.[6] ..... B65D 33/06

[52] U.S. Cl. ..... 190/8; 5/419; 5/656; 297/129; 297/183.5; 297/377; 383/4

[58] Field of Search ..... 383/4; 190/1, 8; 5/417, 419, 652, 656; 297/129, 183.5, 183.6, 183.7, 183.8, 377

[56] References Cited

U.S. PATENT DOCUMENTS

| | | | |
|---|---|---|---|
| 401,653 | 4/1889 | Kaufmann | 297/377 |
| 405,038 | 6/1889 | Koechling | 297/377 |
| 1,447,486 | 3/1923 | Schafet et al. | 297/377 |
| 1,462,005 | 7/1923 | Hall | 297/377 |
| 2,182,516 | 12/1939 | Coble | 297/377 |
| 2,304,700 | 12/1942 | Manville | 5/419 |
| 2,570,571 | 10/1951 | Leeman | 297/129 |
| 2,816,599 | 12/1957 | Adams | 5/419 |
| 2,819,776 | 1/1958 | Balsam | 190/1 |
| 2,828,808 | 5/1958 | Hilton | 297/129 |
| 2,868,274 | 1/1959 | Miller | 190/8 |
| 3,724,617 | 4/1973 | Lawler | 190/1 |
| 4,194,601 | 3/1980 | Yellin | 190/8 |
| 4,466,517 | 8/1984 | Spiegelman | 383/4 |
| 5,094,509 | 3/1992 | Bolzacchini | 297/377 |

FOREIGN PATENT DOCUMENTS

| | | | |
|---|---|---|---|
| 259043 | 1/1963 | Australia | 297/377 |
| 1401953 | 4/1902 | France | 297/377 |
| 1435533 | 5/1976 | United Kingdom | 297/377 |

*Primary Examiner*—Stephen P. Garbe

[57] ABSTRACT

A bag may be converted into a back rest. The fabric is folded to form a bag, and there is a zipper on one side. Three wooden structures are placed in the interior of the bag. These structures provide a back rest when the zipper is opened and the bag is unfolded.

2 Claims, 3 Drawing Sheets

BAG THAT MAY BE CONVERTED INTO A FOLDING BACK REST FOR THE BEACH OR PARK

OBJECT OF THE INVENTION

The present invention, as expressed in this descriptive report, refers to a bag which may be converted into a folding back rest, which has been conceived and realized in order to obtain numerous and notable advantages in respect to other existing resources with similar intentions.

The bag has the capacity to carry various objects within it's interior, as well as inside of a small pocket superimposed on the exterior surface. The bag has a zipper which extends from the top of one side to the opposite side on the botton. The zipper closes two sides of the bag. Opening the zipper and unlatching the end of it, the bag unfolds into a piece of fabric. Within the bag, are three wood structures, designed to fold, and fit one within the other, and convert into a backrest when the zipper is opened and the bag unfolded. At the same time, the wood structures reinforce the shape of the bag. One of the structures which constitutes the back of the back rest, is sewn to the bag fabric. Once the bag is opened and unfolded, it is turned over and the wood structures are assembled in the form of a triangle under the fabric, thus forming the back rest. The fabric of the unfolded bag serves to cover the back rest, and, once it is extended in front, it permits a greater comfort for the user. Summarizing, the proposal is a form of transporting a backrest and other objects all within one bag.

FIELD OF THE INVENTION

Numerous bags and back rests exist, to be transported from one place to another. In this sense there is the beach bag to carry objects, including a back rest.

This system presents the inconvenience of the beach bag becoming independent once emptied at the site to which it is transported. As well as being less efficient as far as the final utility, the independient bag is more difficult to pack and un-pack.

A similar invention is the portable backrest (Num. Pub. Rpi.: 1013306), however, it does not include a bag closed on three sides, to put other objects with the security of not being lost while transported.

DESCRIPTION OF THE INVENTION

The bag of the invention presents a new structure based on obtaining the packing, transportation and un-packing of a back rest and other objects with maximum efficiency. With this reason, the bag is designed to unfold into a piece of fabric which covers the bag rest attached to it, and, at the same time, the ground.

To complement the description and with the objective of providing a better comprehension of the characteristics of the invention, a set of drawings accompany the descriptive report, which should aid in understanding of the innovations and advantages of the bag, object of the invention.

The sizes and materials mentioned are based on one model of the bag, which will have variations. The concept will always be the same in respect to the design.

PREFERRED EMBODIMENT OF THE INVENTION

Figure 1:
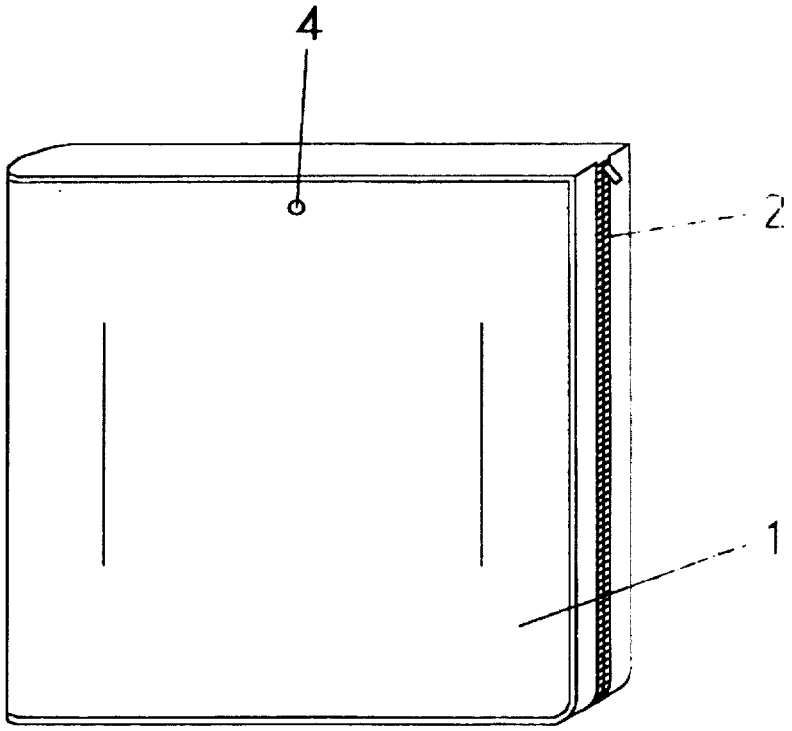
FIG. 1. Shows a view of the bag when closed, on the side where the back of the backrest is sewn on the inside.
Figure 2:
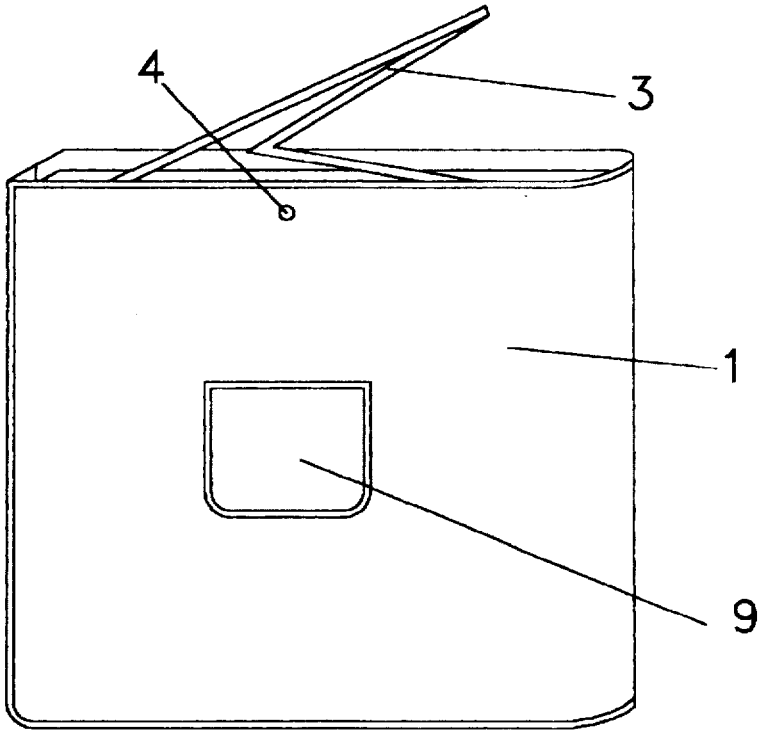
FIG. 2. Shows a view of the bag when closed, on the side which has a pocket superimposed.
Figure 3:
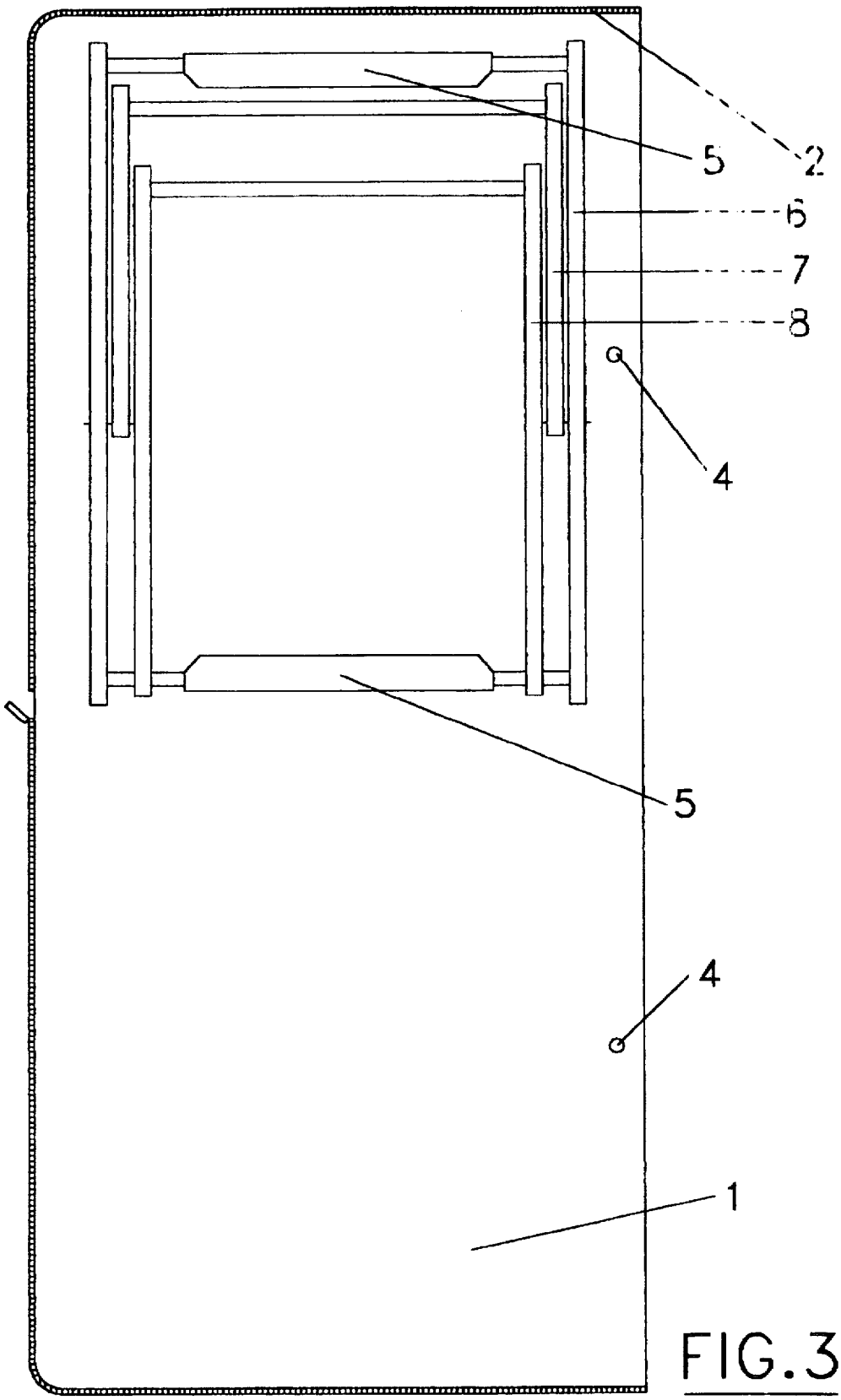
FIG. 3. Shows the bag when open with the folded back rest sewn to the fabric of the bag.
Figure 4:
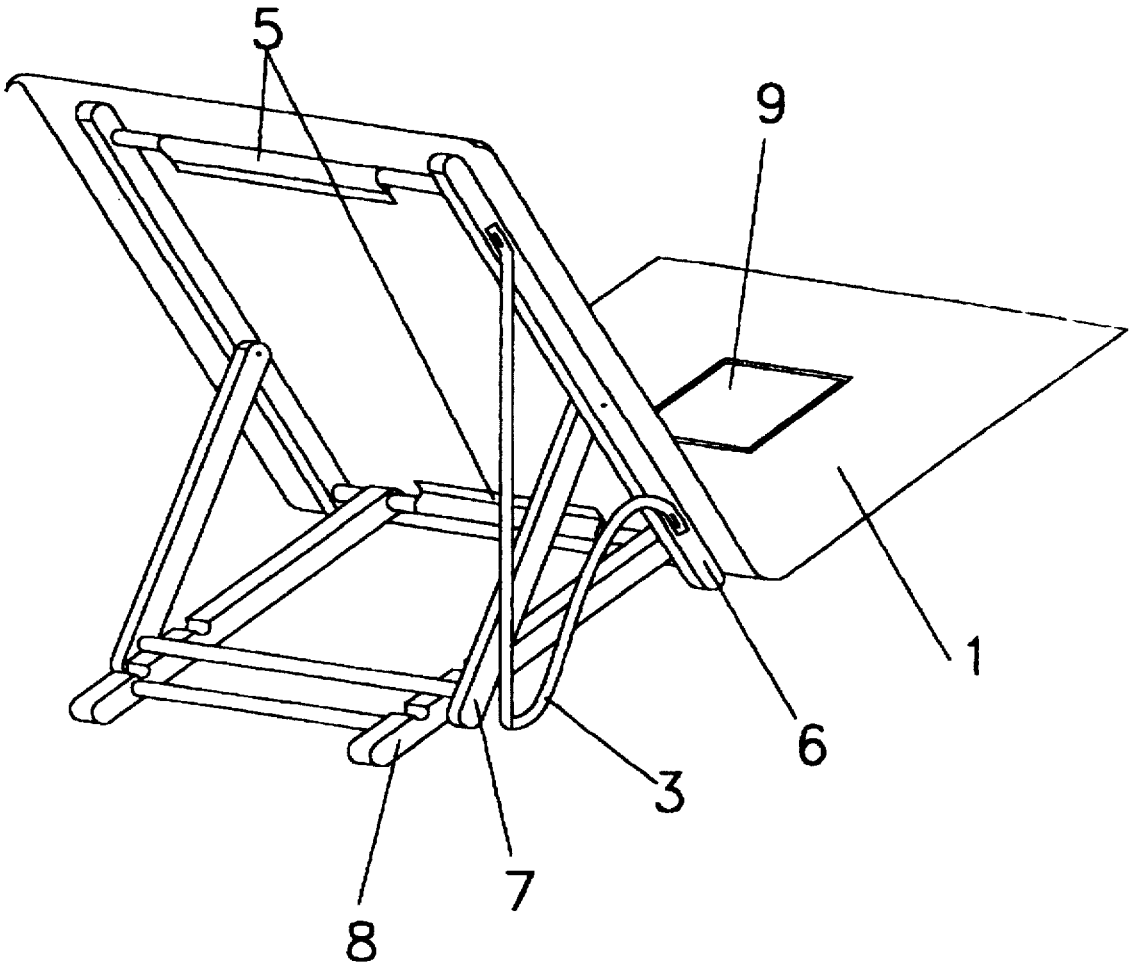
FIG. 4. Shows the bag when opened, with the backrest assembled, forming the triangle of the backrest, seen from behind.

As seen in the commentated drawings, the bag consists of a piece of fabric (1) folded in half to form a bag, closed on the botton to the top of one side by a zipper (2). The bag has a strap (3) and a snap (4). Superimposed on one side of the bag, there is a pocket (9).

Inside of the bag, are three wood structures (6), (7), and (8), folded and fit together, one inside of the other, to finish flat when being transported inside of the bag, thus giving shape to the bag, and convertible into a back rest when the bag is opened.

Sewn to the fabric (1) with two pieces of fabric (5) superimposed, there is a wooden structure (6), in a rectangular form, composed of two pieces of wood and two bars (dowels).

The bars (dowels) are sewn on to the fabric (1), to give the bag shape, and, at the same time, to form the back of the backrest. The ends of the bars (dowels) are embedded in the other two pieces of wood. The strap (3) to carry the bag is attached to one of the pieces of wood of structure (6).

Attached, in an articulated manner, around the center of the structure (6), is another structure (7), composed of two pieces of wood and one bar (dowel), embedded in the opposite ends. The structure (7) serves to hold the structure (6) (the back of the back rest to a third structure (8).

The third structure (8), composed of two pieces of wood and one bar (dowel.), whose two ends are embedded within the two pieces of wood. Three carved notches are seen on these ends of each of the pieces of wood, to hold the bar (dowel) of the structure (7). The two ends of the pieces of wood, opposite to where the bar (dowel) is embedded, have two wholes where the bar (dowel) of the structure (6) passes through to articulate this structure (8).

What is claimed is:

1. A bag convertible into a portable back rest for the beach or park comprising:

a piece of fabric (1), said piece of fabric being foldable in half to a bag having and unfoldable to cover a back rest;

a zipper (2) about edges of said piece of fabric for closing said bag when zipped;

first, second and third structures (6), (7), and (8) for folding and successively fitting one inside the other inside said closed bag and unfolding for providing support for said back rest when said piece of fabric is unfolded;

a strap (3) for carrying said bag; and a pocket on an outer surface of said piece of fabric when said bag is closed, wherein said first structure (6) has four bars connected into a rectangular shape, two opposite ones of said bars being on and sewn to one half of said piece of fabric and said strap (2) is attached to said first structure (6).

2. The bag according to claim 1, wherein said second structure (7) is U-shaped and articulated at an open side of said U-shape to said first structure at a center of two opposite ones of said bars of said first structure (6) and said third structure (8) is U-shaped and articulated at an open side of said U-shape to one of said bars connected between said two opposite ones of said bars of said first structure to the center of which said second structure is articulated.

* * * * *